US007874920B2

(12) United States Patent
Hornik et al.

(10) Patent No.: US 7,874,920 B2
(45) Date of Patent: Jan. 25, 2011

(54) WAGERING GAME WITH UNILATERAL PLAYER SELECTION FOR DEVELOPING A GROUP

(75) Inventors: Jeremy M. Hornik, Chicago, IL (US); Matthew J. Ward, Northbrook, IL (US); Peter W. Flemming, Oak Park, IL (US); Michael P. Casey, Las Vegas, NV (US)

(73) Assignee: VMS Gaming Inc., Waukegan, IL (US)

( * ) Notice: Subject to any disclaimer, the term of this patent is extended or adjusted under 35 U.S.C. 154(b) by 1341 days.

(21) Appl. No.: 11/240,407

(22) Filed: Sep. 30, 2005

(65) Prior Publication Data

US 2006/0100019 A1 May 11, 2006

Related U.S. Application Data

(60) Provisional application No. 60/615,460, filed on Oct. 1, 2004.

(51) Int. Cl.
*A63F 9/24* (2006.01)

(52) U.S. Cl. ..... 463/42; 463/40; 463/16; 463/20; 463/25; 273/138.1; 273/139

(58) Field of Classification Search ..... 463/40, 463/20, 16, 25, 42
See application file for complete search history.

(56) References Cited

U.S. PATENT DOCUMENTS

| | | | |
|---|---|---|---|
| 4,624,459 | A | 11/1986 | Kaufman |
| 4,837,728 | A | 6/1989 | Barrie et al. |
| 4,948,134 | A | 8/1990 | Suttle et al. |
| 5,116,055 | A | 5/1992 | Tracy |
| 5,221,094 | A | 6/1993 | Hanson |
| 5,249,800 | A | 10/1993 | Hilgendorf et al. |
| 5,275,400 | A | 1/1994 | Weingardt et al. |
| 5,344,144 | A | 9/1994 | Canon |
| 5,377,973 | A | 1/1995 | Jones et al. |
| 5,393,057 | A | 2/1995 | Marnell, II |
| 5,401,024 | A | 3/1995 | Simunek |
| 5,524,888 | A | 6/1996 | Heidel |

(Continued)

FOREIGN PATENT DOCUMENTS

| | | |
|---|---|---|
| DE | 19624321 | 6/1996 |

(Continued)

OTHER PUBLICATIONS

Article by Frank Legato, "Battle Plan," *Strictly Slots*, pp. 54-56 (Sep. 2000).

(Continued)

*Primary Examiner*—Dmitry Suhol
*Assistant Examiner*—Chase Leichliter
(74) *Attorney, Agent, or Firm*—Nixon Peabody LLP

(57) ABSTRACT

A wagering game system includes a service for conducting a group-wagering game for a group of players under the control of a gaming control system and a plurality of gaming terminals, each gaming terminal connected to the service and being configured to conduct a group-wagering game in combination with the service. The gaming control system is configured to permit a player in the group of players to unilaterally alter a membership of the group of players.

25 Claims, 5 Drawing Sheets

U.S. PATENT DOCUMENTS 5,544,892 A 8/1996 Breeding
5,564,700 A 10/1996 Celona
5,580,053 A 12/1996 Crouch
5,580,063 A 12/1996 Edwards
5,580,309 A 12/1996 Piechowiak et al.
5,611,730 A 3/1997 Weiss
5,645,486 A 7/1997 Nagao et al.
5,655,961 A 8/1997 Acres et al.
5,755,619 A 5/1998 Matsumoto et al.
5,755,621 A 5/1998 Marks et al.
5,766,076 A 6/1998 Pease et al.
5,772,506 A 6/1998 Marks et al.
RE35,864 E 7/1998 Weingardt
5,779,549 A 7/1998 Walker et al.
5,816,918 A 10/1998 Kelly et al.
5,823,874 A 10/1998 Adams
5,830,063 A 11/1998 Byrne
5,833,537 A 11/1998 Barrie
5,848,932 A 12/1998 Adams
5,855,514 A 1/1999 Kamille
5,855,515 A 1/1999 Pease et al.
5,876,284 A 3/1999 Acres et al.
5,885,158 A 3/1999 Torango et al.
5,897,436 A 4/1999 Singer et al.
5,919,088 A 7/1999 Weiss
5,941,773 A 8/1999 Harlick
5,944,605 A 8/1999 Pajitnov
6,007,427 A 12/1999 Wiener et al.
6,012,982 A 1/2000 Piechowiak et al.
6,015,346 A 1/2000 Bennett
6,039,648 A 3/2000 Guinn et al.
6,047,963 A 4/2000 Pierce et al.
6,077,162 A * 6/2000 Weiss ..... 463/26
6,089,977 A 7/2000 Bennett
6,089,980 A 7/2000 Gauselmann
6,093,100 A 7/2000 Singer et al.
6,102,474 A 8/2000 Daley
6,102,798 A 8/2000 Bennett
6,102,799 A 8/2000 Stupak
6,110,043 A 8/2000 Olsen
6,139,013 A 10/2000 Pierce et al.
6,142,872 A 11/2000 Walker et al.
6,146,273 A 11/2000 Olsen
6,155,567 A * 12/2000 Keleher ..... 273/292
6,155,925 A 12/2000 Giobbi et al.
6,158,741 A 12/2000 Koelling
6,159,097 A 12/2000 Gura
6,168,523 B1 1/2001 Piechowiak et al.
6,203,010 B1 3/2001 Jorasch et al.
6,206,374 B1 3/2001 Jones
6,206,782 B1 3/2001 Walker et al.
6,210,275 B1 4/2001 Olsen
6,210,277 B1 4/2001 Stefan
6,217,448 B1 4/2001 Olsen
6,220,593 B1 4/2001 Pierce et al.
6,224,482 B1 5/2001 Bennett
6,224,484 B1 5/2001 Okuda et al.
6,231,445 B1 5/2001 Acres
6,245,483 B1 6/2001 Oshimo et al.
6,312,332 B1 * 11/2001 Walker et al. ..... 463/23
6,315,660 B1 11/2001 DeMar et al.
6,319,125 B1 11/2001 Acres
6,319,127 B1 11/2001 Walker et al.
6,336,859 B2 1/2002 Jones et al.
6,336,862 B1 1/2002 Byrne
6,345,824 B1 2/2002 Selitzky
6,358,149 B1 3/2002 Schneider et al.
6,361,441 B1 3/2002 Walker et al.
6,364,768 B1 4/2002 Acres et al.
6,371,851 B1 4/2002 Singer et al.
6,375,567 B1 4/2002 Acres
6,375,568 B1 4/2002 Roffman et al.
6,398,644 B1 6/2002 Perrie et al.
6,416,408 B2 7/2002 Tracy et al.
6,416,409 B1 7/2002 Jordan
6,422,940 B1 7/2002 Walker et al.
6,431,983 B2 8/2002 Acres
6,435,968 B1 8/2002 Torango
6,439,995 B1 8/2002 Hughs-Baird et al.
6,482,089 B2 11/2002 DeMar et al.
6,506,117 B2 1/2003 DeMar et al.
6,508,707 B2 1/2003 DeMar et al.
6,517,433 B2 2/2003 Loose et al.
6,520,855 B2 2/2003 DeMar et al.
6,543,774 B1 * 4/2003 Taylor ..... 273/292
6,589,115 B2 7/2003 Walker et al.
6,592,460 B2 7/2003 Torango
6,599,186 B1 7/2003 Walker et al.
6,599,188 B2 7/2003 Hirsch et al.
6,599,193 B2 7/2003 Baerlocher et al.
6,645,071 B2 11/2003 Perrie et al.
6,648,753 B1 11/2003 Tracy et al.
6,648,762 B2 11/2003 Walker et al.
6,692,354 B2 2/2004 Tracy et al.
6,712,695 B2 3/2004 Mothwurf et al.
6,712,699 B2 3/2004 Walker et al.
6,733,390 B2 5/2004 Walker et al.
6,790,141 B2 9/2004 Muir
6,837,793 B2 1/2005 McClintic
6,855,055 B2 2/2005 Perrie et al.
6,869,361 B2 3/2005 Sharpless et al.
7,364,510 B2 * 4/2008 Walker et al. ..... 463/42
2002/0058544 A1 5/2002 Perrie et al.
2002/0138594 A1 9/2002 Rowe
2002/0151345 A1 10/2002 Byrne
2002/0155874 A1 10/2002 Byrne
2003/0027618 A1 2/2003 Byrne
2003/0036430 A1 2/2003 Cannon
2003/0050106 A1 3/2003 Lyfoung
2003/0064776 A1 4/2003 Byrne
2003/0064807 A1 4/2003 Walker et al.
2003/0148808 A1 8/2003 Price
2003/0181231 A1 9/2003 Vancura et al.
2003/0186733 A1 10/2003 Wolf et al.
2003/0216166 A1 11/2003 Baerlocher et al.
2003/0222402 A1 12/2003 Olive
2003/0224852 A1 * 12/2003 Walker et al. ..... 463/20
2003/0228899 A1 12/2003 Evans
2003/0236116 A1 12/2003 Marks et al.
2004/0009808 A1 1/2004 Gauselmann
2004/0009811 A1 1/2004 Torango
2004/0038741 A1 2/2004 Gauselmann
2004/0048644 A1 3/2004 Gerrard et al.
2004/0072602 A1 * 4/2004 Toyoda ..... 463/10
2004/0106448 A1 6/2004 Gauselmann
2004/0204226 A1 10/2004 Foster et al.
2004/0204235 A1 10/2004 Walker et al.
2004/0235552 A1 11/2004 Gauselmann
2004/0242297 A1 12/2004 Walker et al.
2004/0242303 A1 12/2004 Walker et al.
2005/0014554 A1 1/2005 Walker et al.
2005/0026674 A1 2/2005 Wolf et al.
2005/0037833 A1 2/2005 Perrie et al.
2005/0208995 A1 * 9/2005 Marshall et al. ..... 463/25
2006/0068870 A1 * 3/2006 Crawford et al. ..... 463/13
2006/0068917 A1 * 3/2006 Snoddy et al. ..... 463/42

FOREIGN PATENT DOCUMENTS

DE 19515983 11/1996
EP 0 521 599 A1 1/1993
EP 0 862 152 A1 9/1998
EP 0 874 337 A1 10/1998
EP 0 875 870 A2 11/1998

| | | | |
|---|---|---|---|
| EP | 0 875 870 | A3 | 11/1998 |
| EP | 0 875 870 | B1 | 11/1998 |
| GB | 2 105 560 | A | 3/1983 |
| GB | 2 153 572 | A | 12/1983 |
| GB | 2 181 589 | A | 10/1986 |
| GB | 2 242 300 | A | 3/1990 |
| GB | 2 229 371 | A | 9/1990 |
| GB | 2 231 189 | A | 11/1990 |
| GB | 2 252 705 | A | 8/1992 |
| GB | 2 271 262 | A | 4/1994 |
| GB | 2 313 792 | A | 6/1997 |
| GB | 2 333 880 | A | 7/1998 |
| WO | WO 98/09258 | | 3/1998 |
| WO | WO 98/09259 | | 3/1998 |
| WO | WO 99/03078 | | 1/1999 |
| WO | WO 99/19037 | | 4/1999 |
| WO | WO 01/33478 | | 5/2001 |
| WO | WO 03/026754 | | 4/2003 |
| WO | WO 03/083789 | A1 | 10/2003 |

OTHER PUBLICATIONS

Article by Melissa Raimondi, "Slot Toppers," *Strictly Slots*, pp. 72-73 (Dec. 2000).

Article (Author Unknown), *Strictly Slots*, p. 67 (Sep. 2003).

Article for "Easy Riches" by Sigma Game, Strictly Slots, 1 page (Aug. 2001).

Article for "Millioniser" by Glenn Haussman, Strictly Slots, pp. 50-53 (Mar. 2004).

Product Sheet for Big Games Safari, IGT, 24 pages (2000).

"New '97 Games" International Gaming & Wagering Business, 24 pages (Mar. 1997).

* cited by examiner

WAGERING GAME WITH UNILATERAL PLAYER SELECTION FOR DEVELOPING A GROUP

CROSS-REFERENCE To RELATED APPLICATION

This application claims the benefit of the U.S. Provisional Application 60/615,460 filed on Oct. 1, 2004 and entitled "Wagering Game With Unilateral Player Selection For Developing A Group" and this provisional application is hereby incorporated by reference in its entirety.

TECHNICAL FIELD

The present disclosure relates generally to wagering games and, more particularly, to a wagering game permitting unilateral selection for developing a group or team of players.

BACKGROUND

Gaming machines, such as slot machines, video poker machines, and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning each machine is roughly the same (or believed to be the same), players are most likely to be attracted to the most entertaining and exciting of the machines.

Consequently, gaming terminal operators strive to employ the most entertaining and exciting terminals available because such terminals attract frequent play and, hence, increase profitability for the operators. Thus, in the highly competitive gaming terminal industry, there is a continuing need to develop new types of games, or improvements to existing games, that will enhance the entertainment value and excitement associated with the games.

One concept that has been successfully employed in existing gaming terminals to enhance player entertainment is the use of progressive games. In the gaming industry, a "progressive" game involves collecting coin-in data from participating gaming device(s) (e.g., slot machines), contributing a percentage of that coin-in data to a progressive jackpot amount, and awarding that jackpot amount to a player upon the occurrence of a certain jackpot-won event. A jackpot-won event typically occurs when a "progressive winning position" is achieved at a participating gaming device. If the gaming device is a slot machine, a progressive winning position may, for example, correspond to alignment of progressive jackpot reel symbols along a certain payline. The initial progressive jackpot is a predetermined minimum amount. That jackpot amount, however, progressively increases as players continue to play the gaming machine without winning the jackpot. Further, when several gaming machines are linked together such that several players at several gaming machines compete for the same jackpot, the jackpot progressively increases at a much faster rate, which leads to further player excitement.

Another concept that has been employed is that of a secondary or "bonus" game which may be played in conjunction with a "basic" game. The bonus game may include any type of game, either similar to or entirely different from the basic game, and is initiated by the occurrence of certain pre-selected events or outcomes of the basic game. Such a bonus game has been found to produce a significantly higher level of player excitement than the basic game alone because it provides an additional chance to play, which increases the player's overall expectation of winning.

In many existing gaming terminals, the basic game and the bonus game are played on an individual, stand-alone basis wherein each player plays and wins at his or her own gaming terminal without any active involvement or participation from other players at other gaming terminals. In other more recent developments in the gaming industry, provisions have been made for group play and/or group communication, such as disclosed in U.S. patent application Ser. Nos. 60/570,583 (titled "Bank Wagering Game"), 10/369,021 (titled "Communication Between Players At Gaming Terminals") filed Feb. 19, 2003, and 10/612,478 (titled "Gaming Machine Having A Community Game With Side Wagering") filed Jul. 2, 2003, each of which is hereby incorporated by reference in its entirety.

In the traditional, non-machine based casino wagering games, such as poker and blackjack, it has been observed that often-times players are selective about the persons with whom they play. Often, incoming players are given the benefit of the doubt and are welcomed until and unless the incoming player places a bet or commits an act that negatively impacts the other players. One example of this is a player in blackjack who has two face cards showing and chooses to split, thereby taking a risk that they will not end up with an equal hand, instead of forcing the dealer to try to beat the pair of face cards. If such player ends up with two hands each having a face card and a lower ranked card, then the dealer may not need to take extra hits or cards to try to beat such combinations, whereas for the original hand, the dealer would have been forced to try to beat the hand and would likely have ended up losing, to the benefit of all of the other players who might have had lesser hands.

A similar dynamic is present with any group gaming system, whether in the traditional, non-machine based casino wagering games or in the group video, electronic, or machine-based wagering games. After a short period of group play, wherein each player observes each other player's style of play and choices, each player either develops a level of comfort and trust in that individual, maintains an indifference to that individual, or develops a dislike for such individual, for whatever reason. Presently little recourse is available to players who do not connect with their co-players and each player is faced with the option of having to stay at a table or machine wherein they must endure some aspect of another person's play that they dislike or they must leave the table in search of other tables or games.

Accordingly, what is needed is a gaming terminal that is capable of providing increased excitement and entertainment value over existing gaming terminals. More specifically, what is needed is a gaming terminal that can permit unilateral selection for developing a group or team.

SUMMARY

The present concepts are directed to a method and system for conducting a group-wagering game in which players at several gaming terminals may participate in the group-wagering game.

In one aspect, a wagering game system is provided which includes a service for conducting a group-wagering game for a group of players under the control of a gaming control system and a plurality of gaming terminals, each gaming terminal connected to the service and being configured to conduct a group-wagering game in combination with the service. The gaming control system is configured to permit a player in the group of players to unilaterally alter a membership of the group of players.

In another aspect, a method of conducting a group-wagering game involving a plurality of gaming terminals, each gaming terminal connected to a service and being controlled by a gaming control system, is provided and includes the steps of defining at least one group of players from a plurality of players placing wagers on the group-wagering game and permitting at least one player in the at least one group of players to unilaterally alter a membership of the at least one group of players.

A method of conducting a group-wagering game involving a plurality of gaming terminals, each gaming terminal connected to a service and being controlled by a gaming control system, may in accord with another aspect of the present concepts include the acts of defining at least one group of players from a plurality of players placing wagers on the group-wagering game, permitting at least one player in the at least one group of players to unilaterally alter a membership of the at least one group of players, and withholding disclosure of alteration of a membership of the at least one group of players to a removed player. This method also includes the steps of forming another group containing the removed player, using subsequent group-wagering game play by the remainder of remaining members of the at least one group of players to influence game play in subsequent group-wagering game play in the another group, and withholding any aspect of an award won by the another group from any members of the at least one group of players not participating in a wager on an outcome of group-wagering game play by the another group.

Variations of the above-noted method may optionally include the acts of permitting the removed player to unilaterally alter a membership of the another group. Still other variations of this method may optionally include the acts of disclosing alteration of a membership of the at least one group of players to a removed player and to all remaining players in the at least one group of players and permitting the remaining players to place a wager in a group including the removed player and participate in group-wagering games played in both the at least one group of players and in the group including the removed player. Another variation of this method may optionally include the act of permitting the at least one player in the at least one group of players to become a member in a plurality of groups and to participate as a player therein by placing a wager in each group-wagering game conducted by each of the plurality of groups.

In another aspect, a method of operating a gaming terminal includes the steps of receiving a wagering input from a player to play a group-wagering game, displaying a separate indicia for each player in a group of players who will be participating in a group-wagering game with the player, and conducting a group-wagering game on the gaming terminal, wherein each player in the group of players inclusive of the player provides a separate input to the group-wagering game. The method also includes the steps of using the inputs by each player in the group of players to determine an outcome of the group-wagering game and displaying an outcome of the group-wagering game on the gaming terminal. This method also permits the player to unilaterally alter a membership of the group of players prior to the conducting of a group-wagering game and/or subsequent to the displaying of an outcome of the group-wagering game.

In yet another aspect, a gaming terminal is provided which includes a network interface unit for connecting the gaming terminal to a network in which a group-wagering game is conducted and at least one display for displaying terminal-level wagering games conducted by the gaming terminal. In response to unilateral request by at least one player in a group-wagering game to unilaterally alter a membership of a group of players participating in the group-wagering game, the network alters a membership of a group of players playing a group-wagering game. In optional variants of this aspect, the network may be configured to alter a membership of a group of players playing a group-wagering game only for the gaming terminal used by the at least one player or the gaming terminal may be configured to present, on at least one display, an option of removing a player from a group of players of the group-wagering game. In still other optional variants of the above aspect, the gaming terminal may be configured to present, on at least one display, an option of adding a player to a group of players of the group-wagering game. Still further, the gaming terminal may optionally comprise a communications link enabling a player at the gaming terminal to communicate with another player at another gaming terminal.

In still another aspect, a method of conducting a wagering game at a plurality of gaming terminals connected to a service, includes the steps of receiving wager inputs at one or more of the plurality of gaming terminals, defining at least one group of players from a plurality of players inputting wagers on the group-wagering game, and permitting at least one player in the at least one group of players to unilaterally alter a membership of the at least one group of players by adding or removing at least one player. This aspect may further include the act of permitting the at least one player to unilaterally alter a membership of the at least one group of players during a group-wagering game comprising a basic wagering game, or during a group-wagering game comprising a supplemental wagering game, such supplemental wagering game comprising a bonus game, a secondary game, or a progressive game.

The above-noted method of conducting a wagering game at a plurality of gaming terminals connected to a service may also include, in accord with the present concepts, the act of withholding disclosure of alteration of a membership of the at least one group of players to a removed player. This variant of the above-noted method may further include the acts of forming another group containing the removed player, using subsequent group-wagering game play by the remainder of remaining members of the at least one group of players to influence game play in subsequent group-wagering game play in the another group, and withholding any aspect of an award won by the another group from any members of the at least one group of players not participating in a wager on an outcome of group-wagering game play by the another group.

A method of operating a gaming terminal in accord with at least one aspect of the present concepts includes the acts of receiving a wagering input from a player to play a group-wagering game, displaying a separate indicia for each player in a group of players who will be participating in a group-wagering game with the player, and conducting a group-wagering game on the gaming terminal, wherein each player in the group of players inclusive of the player provides a separate input to the group-wagering game. This method also includes the acts of using the inputs by each player in the group of players to determine an outcome of the group-wagering game, displaying an outcome of the group-wagering game on the gaming terminal, and permitting the player to unilaterally alter a membership of the group of players prior to the conducting of a group-wagering game or subsequent to the displaying of an outcome of the group-wagering game.

Yet another aspect of the present concepts includes a method of conducting a group wagering game at a plurality of gaming terminals connected to a service, which comprises the acts of receiving wager inputs at one or more of the plurality of gaming terminals from a first group of players and permitting a first player within the first group to unilaterally alter a membership of the first group to create a second group that is associated with the first player, the first group remaining associated with all other players except for the first player and including the first player. The method also includes the act of, after the permitting act, awarding the first player an award based on outcomes achieved by the second group and awarding all other players an award based on outcomes achieved by the first group.

A wagering game system in accord with at least some aspects of the present concepts includes a service for conducting a group-wagering game for a group of players under the control of a gaming control system and a plurality of gaming terminals, each gaming terminal connected to the service and being configured to conduct a group-wagering game in combination with the service. In this wagering game system, the gaming control system is configured to permit a player to unilaterally select a group of the plurality of players to form a group and game play by each of the plurality of players in the group influences an outcome of an event in a group-wagering game played by the player.

In one aspect of the present concepts, there is provided a wagering game system for conducting a group-wagering game for a group of players including a plurality of linked gaming terminals, each gaming terminal permitting a player at the terminal to unilaterally alter a membership of the group of players.

In another aspect of the present concepts, there is provided a gaming terminal in a wagering game system for conducting a group-wagering game for a group of players, the wagering game system including a plurality of linked gaming terminals, the gaming terminal comprising a user interface permitting a player at the terminal to unilaterally alter a membership of the group of players.

The above summary of the present concepts is not intended to represent each embodiment, or every aspect, of the present concepts. The detailed description and figures will describe many of the embodiments and aspects of the present concepts.

BRIEF DESCRIPTION OF THE DRAWINGS

The following drawings are provided to illustrate various aspects of the concepts detailed herein, wherein.

Figure 1:
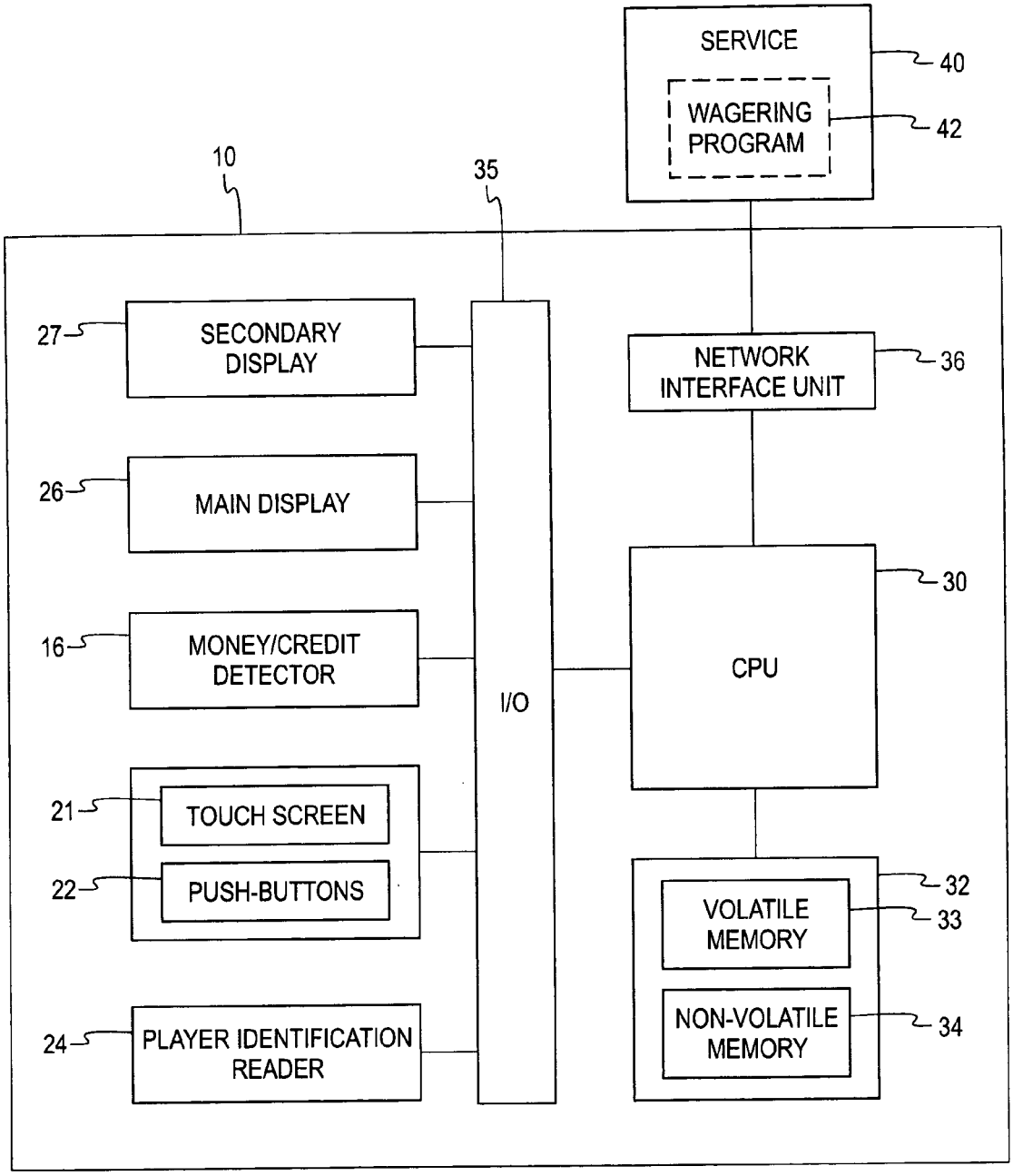
FIG. 1 illustrates a gaming terminal in accord with the present concepts.

While the present concepts are susceptible to various modifications and alternative forms, specific embodiments have been shown by way of example in the drawings and will be described in detail herein. It should be understood, however, that the present concepts are not intended to be limited to the particular forms disclosed, but are intended to include all modifications, equivalents, and alternatives falling within the spirit and scope of the present concepts disclosed herein and defined by the appended claims.

DETAILED DESCRIPTION

A wagering game permitting unilateral selection for developing a group or team is provided herein, as described by way of example in the accompanying examples.

Many people prefer to be play interactively with other players, rather than play in relative isolation. Therefore, a system and method is provided for players at several gaming terminals to play a shared-experience game or a group-wagering game in addition to the normal, terminal-level wagering games.

The present concepts include both the unilateral creation of a group by a player and the unilateral selection for developing a group, which may be a group initially created by the player, a group created by the gaming control system, or a group created by another.

The eligibility of the players to participate in and win at the shared-experience game or at the group-wagering game may be based on any desired criteria, such as but not limited to player participation in a casino "loyalty" program wherein a player ID number is assigned, player wagering amounts (e.g., a minimum bet per play), and/or any other criteria or combination of criterion. In many instances, it is likely that player participation may be open and anonymous.

FIG. 1 shows a representation of an exemplary gaming terminal 10 according to embodiments of the invention. The gaming terminal 10 may be operated as a stand-alone terminal, or it may be connected to a network of gaming terminals. Further, the gaming terminal 10 may be any type of gaming terminal and may have varying structures and methods of operation. For example, the gaming terminal 10 may be a mechanical gaming terminal configured to play mechanical slots, or it may be an electromechanical or electrical gaming terminal configured to play a video casino game such as, but not limited to, blackjack, slots, keno, and poker, and any other associated games (e.g., bonus games having a board-game theme or video-based game theme). In one aspect, the gaming terminal 10 is a video slot machine comprising conventional gaming terminal components including input devices, such as wager acceptor(s) 16, touch screen display 21, push-buttons 22, player-identification card reader 24. The gaming terminal also includes a main display 26 for displaying information about the basic wagering game and may include a secondary display 27 for displaying information about the bonus wagering game. It should be understood that numerous other elements may exist and may be used in any number of combinations to create various forms of a gaming terminal.

The wager acceptor 16 may include any conventional means by which wagers are processed and accepted including but not limited to a card wager acceptor and a currency (i.e., bills, coins, tokens) wager acceptor or any combination thereof. It may comprise, for example, a card wager acceptor including a card-reading device for receiving a stored value card and reading a recorded monetary value associated with the card. The card wager acceptor may also facilitate communication to a remote account, through the network interface unit (NIU) 36 and an associated communications system to permit transfer of money from a player's bank credit account, banking account, or room number (e.g., for guests of a casino having pre-authorized credit) to the gaming terminal 10.

The player-identification card reader 24, if present, is designed to read an identification card and extract information therefrom regarding the player's identity. The identification may then be used by casinos for rewarding certain players with complimentary services or special offers. For example, a player may be enrolled in the gaming establishment's players' club and may be awarded certain complimentary services as that player collects points in his or her player-tracking account. When the player inserts his or her card into the player-identification card reader 24, the casino's computers can register that player's wagering at the gaming terminal 10.

The push buttons 22, which may be mechanical push buttons, allow players to select various options with respect to the games played on the gaming terminal 10. The gaming terminal 10 may also include soft buttons on a touch screen 21 located over the main display 26 that serve similar functions.

The main display 26 displays the outcome of the basic wagering game and may take a variety of forms. For example, the main display 26 may be a conventional 3-slot or 5-slot mechanical reel, or it may take the form of a cathode ray tube (CRT), a liquid crystal display (LCD), a plasma display, or any other type of display that is suitable for simulating mechanical reels or other type of wagering game. A secondary display 27, which may also be a CRT, LCD, plasma display, or other type of suitable display, may be operatively configured to display the basic wagering game and/or another game, such as a secondary game, bonus game, or progressive game.

FIG. 1 shows various components of the gaming terminal 10 in block diagram form. In the illustrated aspect, the gaming terminal 10 is controlled by a central processing unit (CPU) 30 which executes, in accordance with a gaming control system, one or more programs, routines, or instruction sets that randomly selects the outcomes for the gaming terminal and controls the overall operation of the gaming terminal. The gaming terminal 10 also includes a storage unit 32 that includes a volatile memory 33 (e.g., a random-access memory (RAM)) and a non-volatile memory 34 (e.g., hard drive, optical drive, an EEPROM). The gaming terminal 10 and associated gaming control system is capable of locally executing and displaying various wagering games including, but not limited to, a slot machine game, a lottery game, and other types of wagering games commonly played on gaming terminals. The gaming terminal 10 and associated gaming control system is also capable of remotely executing such wagering games on or through a service 40. Service 40 comprises any type of program or instruction set that provides services to programs, controllers, or users in the same computer or processor or in other computers or processors and may be implemented in a centralized or in a distributed or de-centralized architecture. For example, a service may be implemented in combination with an associated computer or controller to configure a plurality of gaming terminals in a peer-to-peer architecture, a client-server based architecture, or even a master/slave architecture.

CPU 30 may generally include one or more processors in a centralized or distributed arrangement. Similarly, the storage unit 32 may include multiple volatile memories and non-volatile memories. The gaming terminal 10 may itself be a slave terminal to a remotely located (i.e., not within the gaming terminal) gaming control system which may comprise one or more processors operating in conjunction with programs, routines, or instruction sets (e.g., wagering program 42) resident in conventional storage media to randomly select the outcomes for the gaming terminal and controls the overall operation of the gaming terminal. Examples of such centralized gaming systems are provided in U.S. Pat. No. 6,749,510 and U.S. Patent Application Publication No. 2003/0232650 titled "Dynamic Configuration of a Gaming System" to Beatty, incorporated by reference herein in their entirety.

The NIU 36 connects the gaming terminal 10 to the service 40 through conventional I/O ports and communication paths (e.g. serial, parallel, IR, RC, 10bT, etc.). In one aspect, the service 40 is configured to conduct a real-time, group-wagering game in which players at several gaming terminals may participate and win together as a group. In another aspect, the service 40 is configured to facilitate communication between a plurality of connected gaming terminals 10 to facilitate non-simultaneous game play between the plurality of connected gaming terminals in association with the game control systems resident in each individual gaming terminal or in a centralized processing system. One example of this may be found in U.S. Pat. No. 6,364,314, which is incorporated by reference herein in its entirety. Although simultaneity of game play presents one advantageous aspect of potential game play, it is not necessary in accord with the present concepts and game play may be simultaneous, substantially simultaneous, or non-simultaneous.

The NIU 36 facilitates communication of data between the gaming terminal 10 and a host or distributed computer system (e.g., other gaming terminals connected together in a network) to optionally enable the performance of specific functions related to the communicated data (e.g., accounting, player-tracking, or a progressive game control system, etc). To set up a typical serial communication hardware link to the host system, a typical RS-232 point-to-point communication protocol that is often present in the gaming terminal 10 is preferably converted to an RS-485 (or RS-485-type) master-slave protocol using a Slot Machine Interface Board, which converts the RS-232 input data from a proprietary gaming terminal protocol to the RS-485 (or proprietary RS-485-type) host communication protocol. The gaming terminal 10 can also initially be designed for a typical RS-485 protocol.

The gaming control system, which includes wagering program 42, may comprise software or instructions to determine whether or not individual players or terminals, if the players at the terminals are anonymous, are eligible to participate in a group-wagering game or in an on-going game having a plurality of players. In one aspect, the gaming control system periodically (e.g., every 5 seconds, 30 seconds, or minute) obtains wager information from the gaming terminals 10 connected to the service 40 to determine, for example, whether a player had initiated play at a gaming terminal 10 within a time period open for entry into a group-wagering game. The amount of the wagers may also be a factor analyzed by the gaming control system to determine whether or not a given player (or terminal) is eligible to participate in a given group-wagering game. For example, in one aspect, players at all gaming terminals connected to the service 40 are eligible regardless of the wager amounts as long as the players are currently playing at the gaming terminals. In another aspect, however, a pre-determined minimum wager (e.g., a current wager or an averaged wager over some time period) may be required to permit entry into the group-wagering game or into a group-based game.

In a group-wagering game, an eligibility period may be defined to delineate an entry period wherein players may enter a subsequent group-wagering game. This eligibility period may be a pre-determined time period opened at the end of each group-based game or may be an open time period set to expire upon the satisfaction of a predetermined precondition (e.g., a certain minimum number of players).

In the basic wagering game, eligible players are awarded a prize (e.g., cash, credits, gifts certificates, etc.) outright, without any further requirement for participation. Other prizes may include entry into a supplemental game, such as a secondary game, bonus game, or progressive game, which provides further opportunity for prizes and may optionally provide enhanced odds of attaining such prizes above that of the basic wagering game.

The group-wagering game may include both the basic wagering game and/or any secondary, bonus, or progressive game associated therewith. For example, during a group-wagering basic game, one player in the group may satisfy a condition for entry into a progressive game. In one aspect, all members of the group may then play a progressive game. In another aspect, the individual satisfying the condition for entry into the progressive game plays the progressive game and all of the members of the group receive a predetermined award or portion of any award won by such person during the progressive game play upon satisfaction of a pre-condition for such award. In this latter aspect, it is advantageous for the progress of the player's progressive game to be displayed to all members of the group to heighten excitement.

To further heighten excitement, the gaming control system may foster cooperative group play by calling upon one or more random group-members not satisfying the condition for entry into the supplemental game to assist the player in making a choice (e.g., majority rule) or in accomplishing some feat presented during the supplemental game play. For example, in Robin Hood's Sherwood Treasure™, the player satisfying the condition for entry into the bonus game may select from archers Little John, Scarlett, Clarinda, and Finny, wherein each of these archers corresponds to one of the other players and such player may be given some degree of control or complete control over the shot fired by such archer. Alternately, the gaming control system may encourage friendly competition between group-members by pitting group-members against each other during supplemental game play, with the award during such supplemental game play being either determined by the outcome or selected by the winning player. In one example thereof, animation taking the form of hand-drawn animation showing an action, computer animated action, video or film representations, or any other visible movement corresponding to a selected option, may be provided with a theme (e.g, a sport's theme) consistent with the basic wagering game and/or gaming terminal, in which "opposing" players each control an aspect of such animation (e.g., opposing boxers in a boxing match). In response to the respective player's selection of an option and/or activation of a switch, the depiction of the outcome may be displayed using the aforementioned animation. Examples of gaming animation are discussed in U.S. Pat. No. 6,592,457 and U.S. Patent Application No. 2004/0053686 titled "Gaming machine performing real-time 3D rendering of gaming events" to Pacey et al., which are incorporated by reference herein in their entirety. Further, such competitive or cooperative aspects of game play may be incorporated into the basic group-wagering game.

In still other aspects, the conditions for entry into a supplemental game, such as a secondary game, bonus game, or progressive game, may be altered in accord with the number of players playing in a group at any given time. For example, a group of three players is statistically less likely to satisfy an entry condition for a bonus game than a group of five players, all other conditions being equal. The odds of any particular event for entry into a supplemental game may therefore be set to vary in accord with a number of players in a particular game. This could facilitate, for example, normalizing of group-wagering game play. To encourage group-wagering game play, additional incentives to group game play may also be provided, such as additional chances for entry into a supplemental game which may include, for example, events across the player's terminals. One example of this could be, for a 5-player group playing a card-based wagering game, a full house comprising the first card of each player (e.g., players 1-2 have a ten and players 3-5 have a seven).

Thus, the gaming control system may regulate the group-wagering or group-based game play and payout to provide different outcomes or prizes based on factors underlying the game play. Obviously, the characteristics, rules, and odds, of any gaming scenario are advantageously displayed at the gaming terminals (e.g., on the main display 26 or the secondary display 27) of each associated gaming terminal to inform each prospective player of such group-wagering game.

Figure 2:
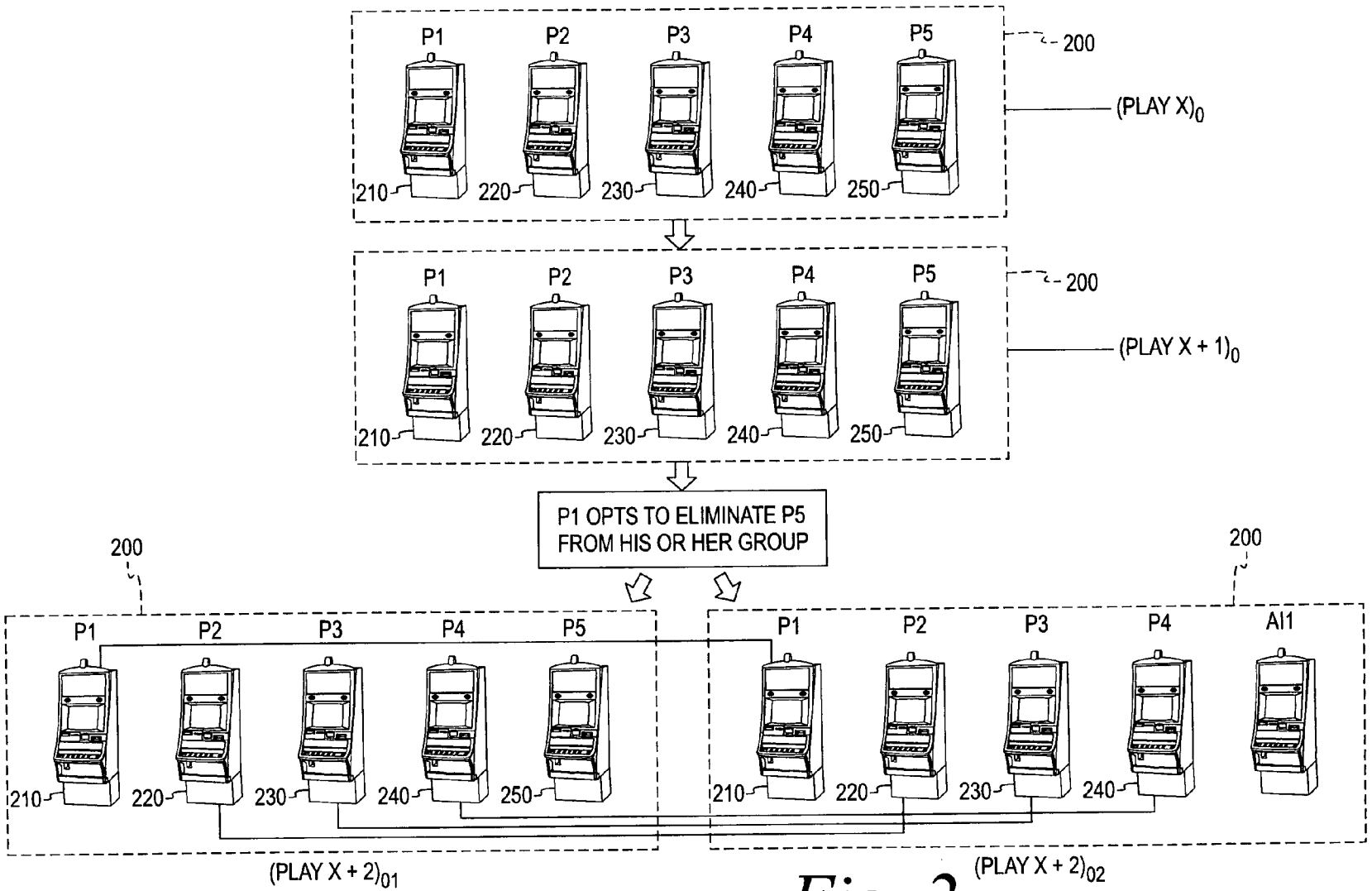
FIG. 2 shows a first example of a unilateral group selection in accord with the present concepts.

FIGS. 2-5 illustrate exemplary implementations of a group-wagering game system according to the present concepts. As can be seen in FIG. 2, a group of gaming terminals 210, 220, 230, 240, and 250 are connected together as a grouping within a gaming control system 200. The gaming terminals 210-250 may be any suitable gaming terminal, including mechanical gaming terminals configured to play mechanical slots, electrical or electro-mechanical gaming terminals configured to play, for example, video casino games such as blackjack, slots, keno, poker, and the like, or any other video-based wagering game. Each gaming terminal 210-250 may be configured to play a different basic wagering game, but are preferably configured to play the same basic wagering game.

The gaming terminals 210-250 allow players to play a normal, terminal-level wagering game, including a basic wagering game and, perhaps, a supplemental game, such as a bonus wagering game. In addition, the gaming control system 200 allows players on gaming terminals 210-250 to participate in a bank-level or group-wagering game conducted by means of a service (not shown). For simplicity, a detailed treatment of community game-play player and eligibility for the group-wagering game based on factors such as timing of entry, player identification information, wagering amounts, wagering history, etc., are not provided herein. These variables may be set or modified in any conventional manner. Examples may be found, for example, in PCT Application No. PCT/US2005/015687, titled "Bank Wagering Game" filed on May 5, 2005, and U.S. Published Patent Application Nos. 2004/0152509 titled "Gaming Device For Wagering On Multiple Game Outcomes" to Hornik et al. and 2004/0166940 titled "Configuration of Gaming Machines" to Rothschild, which are incorporated herein by reference in their entirety.

Turning to FIG. 2, the upper representation of the group of gaming terminals 210, 220, 230, 240, and 250 connected together by gaming control system 200 is shown in a state $(\text{Play X})_O$, which represents the $X^{th}$ play for this particular grouping, represented by the "O" subscript. Designators P1-P5 represent players 1-5, respectively. The next lower representation of the group of gaming terminals 210, 220, 230, 240, and 250 connected together by gaming control system 200 is shown in a state $(\text{Play X+1})_O$, which represents the $(X+1)^{th}$ play for this particular grouping. At this point, player 1 (P1) opts to eliminate player five (P5) from his or her group, for whatever reason. This elimination may be achieved by selection of an icon or activation of a switch corresponding to such function.

The group represented in FIG. 2, is shown in the middle of play (e.g., Play X, as opposed to Play 1). Such group may have initially been unilaterally created by player one, may have been created by the gaming control system 200, or may have been created by another player. In the situation wherein a player, such as player one, is joining the game and desires to create his or her own group, the player may be presented with the option of selecting from any player currently residing in the game space. This selection may be preceded by a review of various statistics of game play for such players, which may include but are not limited to declared experience level, apparent experience level, rate of play, range of wagers, average of wagers, duration of sustained play, winnings per play, and winnings during session. Once selected, the players may be completely insulated from knowledge that they have been selected to influence the outcome of play in another player's group and may be divorced from any potential award outcomes from such group, despite their influence over such outcomes. In another aspect, the players selected may be notified that have been selected for another player's group, such as by a running counter provided on the selected players display or a text message. In this aspect, the selected player may optionally benefit from any award outcomes received by a player who placed the selected player in the player's group.

In accord with the present concepts, the gaming control system 200 facilitates such unilateral selection by forming a new grouping in which player 5 (P5) at terminal 250 is dropped from the group including player one (P1) at terminal 210. Thus, the original grouping is divided into two groups, represented by the subscripts "O1" and "O2," respectively, prior to play X+2. In one aspect, P1 may be thought of as being a "lead" player in group O1, wherein P1 assumes the entire risk and can profit from the entire award, with no attendant risk or reward to the remaining "follower" players. In the illustrated aspect, players P2-P5 in group O1 still view the group as being intact and are unaware that P1 has dropped P5 from his or her group. P1's play, now in group O2, is replicated in group O1, as shown by the arrow, since no one in group O1 opted to remove P1 from their group. As shown in this example, P5 in group O2 is replaced by a computer generated player AI1. Thus, P1 has unilaterally changed the group in which he or she is playing to suit his or her preferences. In this situation, P1's play has the potential to influence the outcome in games played in group O2. In one aspect, until and unless removed from such grouping by one of the players therein, the gaming control system 200 prevents P1 from profiting from any awards to group O1 since P1 has effectively opted out from this group. In another aspect, the gaming control system 200 permits P1 to profit or share in awards to group O1 as a reward for retention by group O1. Likewise, in the illustrated example, P2-P4's play is replicated in group O2, as shown by the corresponding arrows, as P1 did not eliminate their contribution to the group desired by P1. In one aspect, P2-P4 may similarly be prohibited from profiting from any awards that might be entitled to group O2 or may permitted to profit therefrom. In another aspect, since P2-P4 did not themselves elect to be part of multiple groups, but instead are the recipients of favor by multiple groups, provision can be made for rendering some award or portion of an award to a group, such as O2, to P2-P4 based on the knowing or unknowing participation in such group.

The computer generated player AI1 (generally AIn) reflects computer generated play to fulfill the requirement or desire for a particular number of players in a group. The computer generated player AI1 comprises a program, routine, or instruction set, wherein the responses of AI1 may be completely random (e.g., slots) or may include logical outcomes based upon known variables and odds (e.g., a decision as to whether to accept a hit in blackjack). The computer generated player AI1 may optionally comprise a learning routine (i.e., artificial intelligence) that adjusts itself to game play of one or more players to foster a desired outcome, such as increased excitement, enhanced fairness, and/or comfort. The computer generated player AI1 or AIn may therefore also include different personalities, including computer generated players that may be risk averse, on one hand, or care-free on the other hand, or computer generated players which may be experienced or relatively "inexperienced". The gaming control system 200 may arbitrarily assign a computer generated player AI1 to a grouping that is down a player until such time as the group is again changed to add another player in favor of the computer generated player.

When a player, such as P1 in FIG. 2, decides to alter the group in which P1 is a part, the alteration may be transparent to the other players P2-P5, such as shown in FIG. 2. Each player is therefore enabled to blithely continue with their gaming experience in a group of their choosing, without being burdened by the knowledge that some of their co-players might not have shared reciprocal attitudes. Alternately, to simplify game-play and accounting, the other players not de-selected by P1 may be given a choice to remain with P1 or to stay with P5 or to take some other course of action, such as withdrawing from both the groups including both P1 and P5. This chance to select, de-select, or modify groups may be presented prior to the start of each round of play, provided such timing of play is regulated by the gaming control system 200, or may be event driven, such as by the instruction by a player to the gaming control system to effect such a change.

In still another aspect, the each player may be given the option to continue play in one or more group-wagering games (e.g., a predetermined plurality of group-wagering games inclusive of 2, 3, or 4 games), which may be facilitated by one or more split screens or PIP (picture in picture) displays on one or more displays (e.g., main display 26, secondary display 27). Once a player participates in a full complement of group-wagering games, further opportunities to select groups may be provided only in place of de-selection of one of the existing groups. Thus, in this aspect, each player has full knowledge of every group of which they form a part, directly or indirectly. Participation in multiple groups may be conditioned, for example, on the inclusion of additional wagers corresponding to the selected number of groups. For example, if the player does not wish to place an additional wager to join an additional group, the gaming control system 200 may prevent the player from playing in an additional group or may permit such play, but prevent the player from profiting from any award to such group. If the player joins a group and places a minimal wager, they will receive a correspondingly nominal percentage of an award to such group. Likewise, if the player joins a group and places a maximum wager, they will receive a correspondingly larger percentage of an award to such group. In this manner, the gaming control system 200 facilitates fair play and just remuneration and further provides the capability for fast-paced game play.

Figure 3:
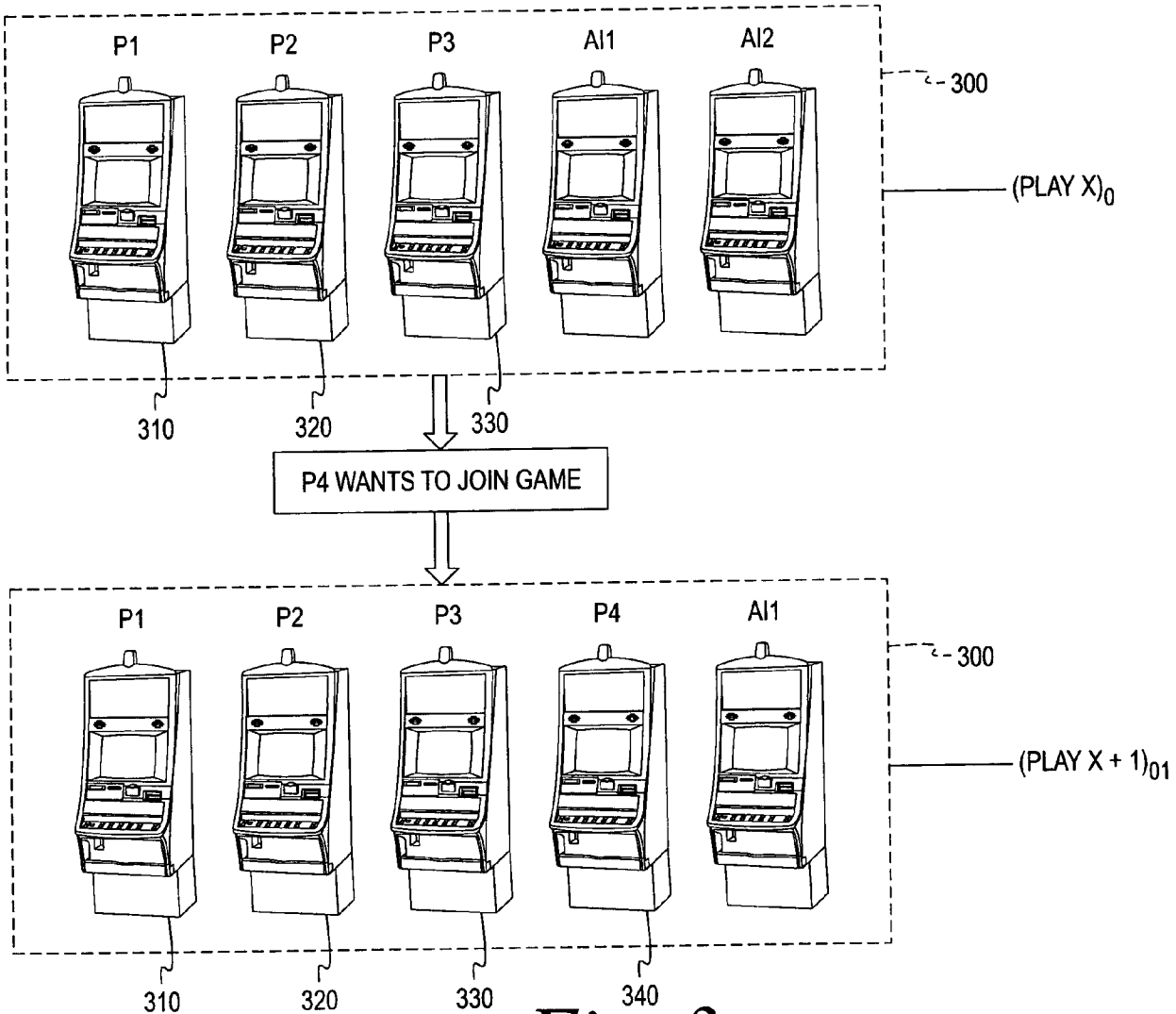
FIG. 3 shows a second example of a unilateral group selection in accord with the present concepts.

FIG. 3 shows an example wherein a group of gaming terminals 310, 320, and 330 are connected together by gaming control system 300 in a group including computer generated players AI1 and AI2. In this example, a player P4 wants to join the on-going game following play X of the group O, represented as $(\text{Play X})_O$. Gaming control system 300 facilitates this request by simply replacing a computer generated player AI2 by player P4 in a subsequent round of play, represented as $(\text{Play X+1})_{O1}$. For consistency with the previous example, the group number is represented as the subscript O1 to reflect the change to the original group represented by the subscript O. In the example of FIG. 3, the new player is granted an automatic entry into group O as a replacement for a computer generated player. If desired, any of players P1-P3 may later elect to remove P4 from the group, as noted above.

Figure 4:
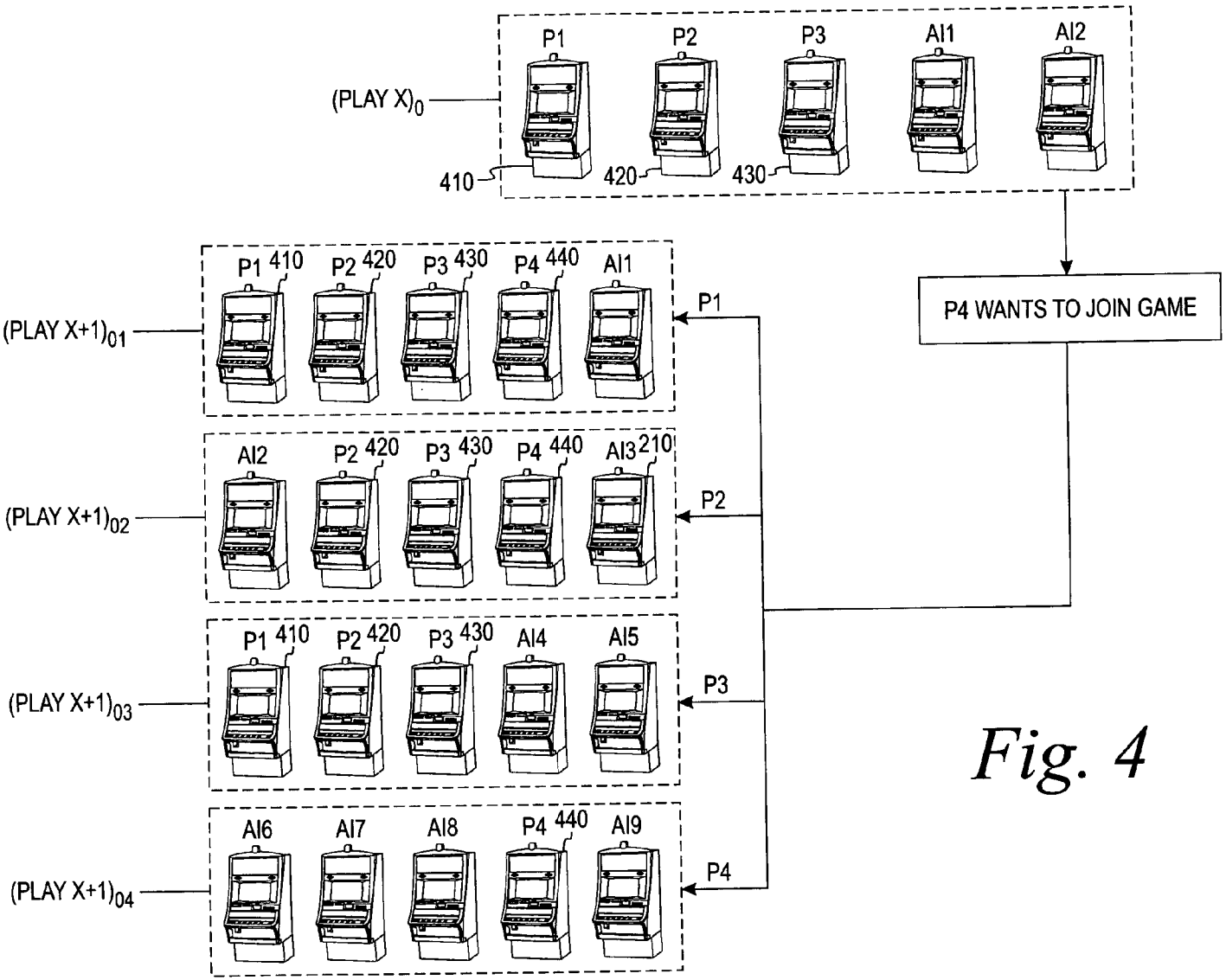
FIG. 4 shows a third example of a unilateral group selection in accord with the present concepts.

FIG. 4 shows an alternative example to FIG. 3. FIG. 4 shows a group of gaming terminals 410, 420, and 430 connected together by gaming control system 400 in a group including computer generated players AI1 and AI2. In this example, a player P4 wants to join the on-going game following play X of the group O, represented as (Play X)$_O$. Gaming control system 400 facilitates this request by polling the players P1-P3 to take into account their preferences, shown by the branching of group O into separate groups O1, O2, O3, and O4. FIG. 4 shows that player P1 accepts the entry of player P4, forming the group O1 comprising P1-P4 and AI1. Player P2 accepts the entry of player P4, but decides to drop player P1 from his or her group, thereby forming the group O2 comprising P2-P4 and AI3. Player P3 refuses the entry of player P4 into his or her group, and retains two computer generated players AI4, AI5. P4, given the opportunity, elects to initially play by himself or herself, such as to learn how to play the game without invoking the ire of other players, and opts to play with computer generated players AI6-AI9 in a group O4. As noted above, the gaming control system 400 facilitates such unilateral selection by forming new groupings, as necessary. In the illustrated aspects, player P1 is the "lead" player in group O1, player P2 is the "lead" player in group O2, player P3 is the "lead" player in group O3, and player P4 is the "lead" player in group O4. These players, who unilaterally control the members of their individual group, bear by default the risk and reward following the plays by the players in the group. As noted above, the risk and reward may optionally be shared by other members of the group following acceptance of such risk and potential for reward by such player in consideration of an additional wager.

Figure 5:
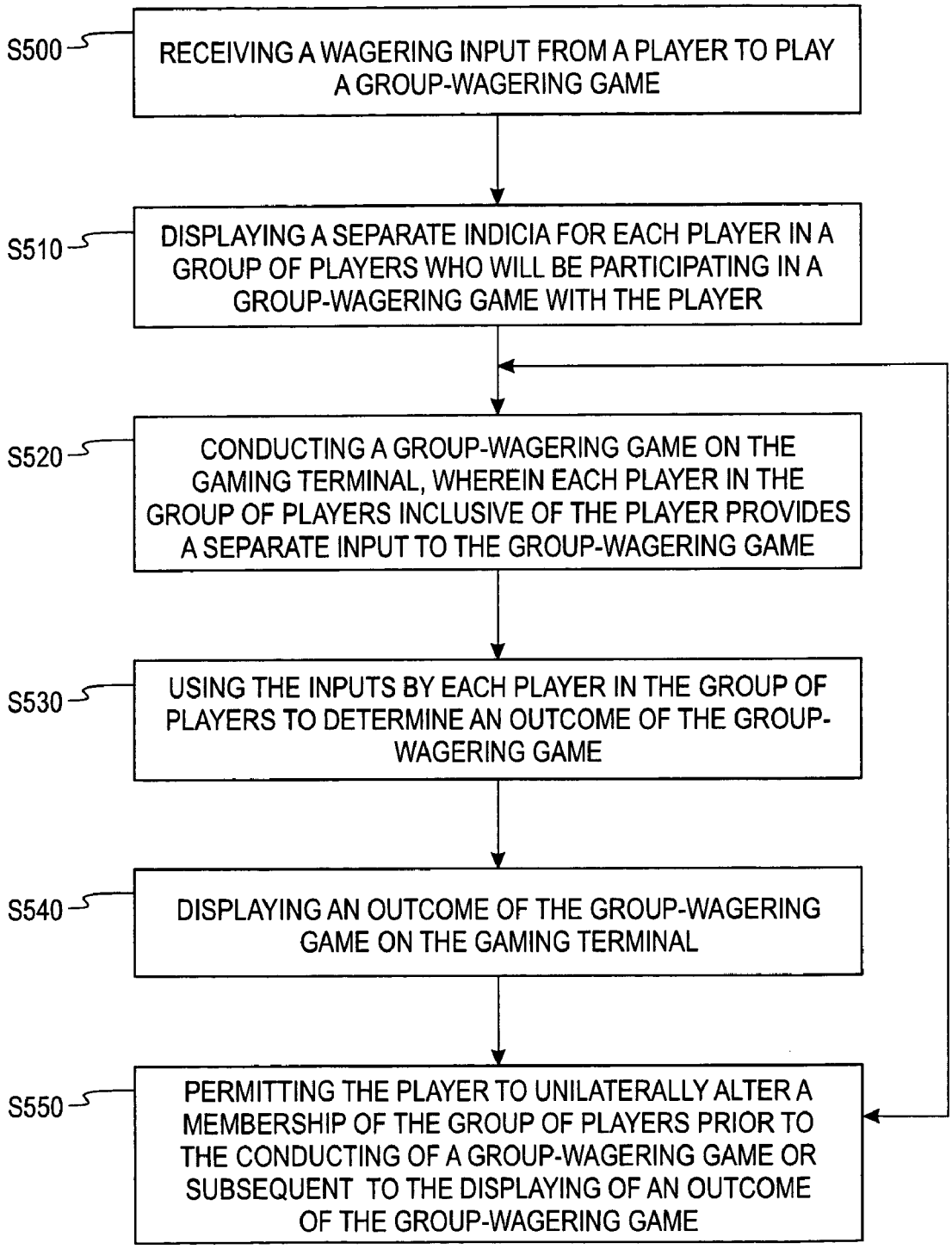
FIG. 5 shows a flowchart of a method for unilateral group selection in accord with the present concepts.

FIG. 5 shows a flowchart of one example of a method for unilateral group selection in accord with the present concepts. The illustrated method of operating a gaming terminal includes, in step 500, receiving a wagering input from a player to play a group-wagering game. Step 510 includes displaying a separate indicia for each player in a group of players who will be participating in a group-wagering game with the player indicated in step 500. At this time, the player at the gaming terminal may be permitted, in step 550, to unilaterally alter a membership of the group of players prior to the conduct of a group-wagering game. Alternatively, the player at the gaming terminal may proceed to step 520, which includes conducting a group-wagering game on the gaming terminal, wherein each player in the group of players (inclusive of the player at the gaming terminal) provides a separate input to the group-wagering game. In step 530, the gaming control system uses the inputs by each player in the group of players to determine an outcome of the group-wagering game. The inputs may comprise any input of any conventional gaming terminal and/or wagering game. For example, the input could comprise the selection of a random element on a display using a mouse, keyboard, cursor, button, joystick, light beam, vocalization, or the like, or could comprise the activation of a switch on the gaming terminals. In step 540, the gaming terminal displays an outcome of the group-wagering game. Following the display of the outcome of the group-wagering game, the player may be provided an opportunity (or another opportunity) to unilaterally alter a membership of the group of players.

The concepts disclosed herein may be applied to any multi-player wagering game. Further to the basic description of unilateral selection noted above, various games into which this feature is provided may incorporate additional elements to facilitate game play or to heighten playing excitement. In one aspect, players may receive additional awards or benefits, or additional opportunities for benefits or awards, based on the existence of the group or based on the outcomes of game play by the other group members. For example, in a cooperatively based multi-player wagering game, the game may provide an advantage to the group if each player or participant collects certain winning combinations or causes the display of a certain indicia or combination of indicia on a reel across a pay-line. In a board-type game implementation, for example, the game may provide an advantage to the group if the group is able to accumulate certain groupings or combinations of objects, such as by collectively landing on related board game squares that complete a predetermined grouping. In one aspect, each group member may be randomly assigned an objective to meet, such as a certain indicia on a predetermined reel position. Alternatively, a plurality of conditions are required to be satisfied by the group as a whole and it does not matter which group member satisfies each of the conditions. If each member of the group is able to fulfill his or her objective or if the group is able to fulfill its objective, then the group may receive a special award. In still another aspect, time limits may be imposed on the receipt of an award based on group collection activities to increase excitement. If the group is unable to accomplish the task or collect the requisite events, the potential award attached thereto is lost, but is likely to be followed by another task or objective, to which another award may be linked. Further, multiple collection-based opportunities or potential task-based awards, such as noted above, may be available to the group at any given time.

Group members may also place side wagers on other group players. Thus, player one (P1) may place an additional wager that player three (P3) will achieve a certain outcome within the next play or within a predetermined number of plays. If player three achieves such outcome within the specified number of plays or period of time, then player one can also win if and when player three wins. The outcome may be any selected outcome based on the elements and theme of the group-wagering game. In the collection-based opportunities noted above, player one might place a side wager that player three will achieve, within a specified number of turns or time period, an objective assigned to player three by the gaming control system as a precondition for a group-based award. If player three satisfies such objective, then player one will receive both a group-based award (if all other conditions for such award have been met) and a separate award based on the side wager. As one example, in a video-based reel game, player one may place a side wager that player three will have a pair of symbols along a pay-line in the next turn or that player three will have a three-of-a-kind along a pay-line within five turns. Additional disclosure of side wagering in a group-based game is provided in co-pending U.S. Published Pat. Appl. No. 2005/0003886 titled "Gaming Machine Having A Community Game With Side Wagering," incorporated by reference in its entirety herein.

While the present invention has been described with reference to one or more particular embodiments, those skilled in the art will recognize that many changes may be made thereto without departing from the spirit and scope of the present invention. The groups described above may include any number of players inclusive of two players, three players, four players, five players, or more than five players, depending on the ability of the underlying gaming platform to support such play. Further, in situations wherein a plurality of players are seeking entry into a group that cannot support such plurality of players, the gaming control system may arbitrarily create a new group and assign the plurality of players to such new group, with a complement of computer generated players as needed to fill out the group. From this point, the individual players may make choices and take any additional actions desired to unilaterally effect change within their group.

The present concepts also include the potential for recruitment of players from other groups to join another group. Such recruitment may utilize communication means inclusive of text messaging or emails, outlined in co-pending U.S. Published. Pat. Appl. No. 2004/0162144 titled "Communication Between Players At Gaming Terminals," which is incorporated herein by reference. Recruitment may require the input of an additional wager or fee by either of the recruiting player or the recruited player. As an additional feature in accord with the present concepts, a timeout clock may be utilized to forfeit a player's turn or roll for a game involving a group and a stand-in computer generated player may play in the players stead for a single turn, with no loss or award to such player, to prevent stagnation of game play caused by one player.

To enhance game play, each player may select an avatar (e.g., an image representing a user in a multi-user virtual reality) To enhance game play, each player may select an avatar (e.g., an image representing a user in a multi-user virtual reality) from a plurality of available avatars to represent their persona to other players. The image of the avatar may comprise any graphic form including but not limited to hand drawn or computer-drawn images, photos, icons, or even "morphed" images.

In still another aspect, the concepts herein may be applied to a sports-based, networked gaming platform comprising a plurality of linked gaming terminals. Each player would select an avatar from a group comprising sports personalities, each such personality optionally have advantages or disadvantages which might influence game play. Statistics for each sports personality could be electronically updated regularly (e.g., daily, weekly, etc.) to keep the game current with ongoing sporting activities. Such a platform could produce an exciting variant of fantasy baseball, for example, wherein each player is a free agent and seek to build groups having the greatest likelihood of achieving an event that will benefit the group. Since the population of sports personalities is limited, other variants could introduce historical sports personalities, sports personalities from other countries, or computer-generated sports personalities. In such a game, the withdrawal of a member from a group could advantageously be made absolute so that each player may only be present in or able to influence a single group, but players would be empowered to selectively "release" any player of their choosing from their own group and would be free to recruit "sports figures" from other groups. Such recruitment could precede the release of a player, or a player could be released and immediately replaced by a computer generated player. As noted above, such recruitment could optionally include a nominal cost to the player doing the recruiting and/or to the recruited player. In an aspect wherein a selected avatar comprising a sports personality may convey particular advantages to the player, based on the sports personality's statistics, a player may be required to incur some cost to at least partially offset such benefit, such as by requiring higher base wagers in each play. In other aspects, the avatars convey no benefit or detriment and are used purely to heighten player enjoyment.

Plurality of available avatars to represent their persona to other players. The image of the avatar may comprise any graphic form including but not limited to hand drawn or computer-drawn images, photos, icons, or even "morphed" images.

In still another aspect, the concepts herein may be applied to a sports-based, networked gaming platform comprising a plurality of linked gaming terminals. Each player would select an avatar from a group comprising sports personalities, each such personality optionally have advantages or disadvantages which might influence game play. Statistics for each sports personality could be electronically updated regularly (e.g., daily, weekly, etc.) to keep the game current with ongoing sporting activities. Such a platform could produce an exciting variant of fantasy baseball, for example, wherein each player is a free agent and seek to build groups having the greatest likelihood of achieving an event that will benefit the group. Since the population of sports personalities is limited, other variants could introduce historical sports personalities, sports personalities from other countries, or computer-generated sports personalities. In such a game, the withdrawal of a member from a group could advantageously be made absolute so that each player may only be present in or able to influence a single group, but players would be empowered to selectively "release" any player of their choosing from their own group and would be free to recruit "sports figures" from other groups. Such recruitment could precede the release of a player, or a player could be released and immediately replaced by a computer generated player. As noted above, such recruitment could optionally include a nominal cost to the player doing the recruiting and/or to the recruited player.

Each of these embodiments and obvious variations thereof is contemplated as falling within the spirit and scope of the claimed invention, which is set forth in the following claims.

What is claimed is:

1. A wagering game system, comprising:

a service for conducting a group-wagering game for a group of players under the control of a gaming control system; and a plurality of gaming terminals, each gaming terminal connected to said service and being configured to conduct a group-wagering game in combination with said service, wherein the gaming control system is configured to permit a player in the group of players to unilaterally alter a membership of another player of said group of players by removing said another player from the group, said another player being automatically placed in another group for continued and substantially uninterrupted play of the group-wagering game.

2. The wagering game system according to claim 1, wherein the gaming control system is configured to permit a player in the group of players to unilaterally alter a membership of said group of players to add or remove at least one player.

3. The wagering game system according to claim 2, wherein the gaming control system is configured not to disclose alteration of a membership to a removed player.

4. The wagering game system according to claim 3, wherein the alteration of a membership of said group of players to remove said player is achieved by forming a second group containing said removed player.

5. The wagering game system according to claim 4, wherein subsequent group-wagering game play by the remainder of said group of players is replicated within the second group.

6. The wagering game system according to claim 2, wherein information regarding the alteration of a membership of said group of players is disseminated at least to a removed group member.

7. The wagering game system according to claim 1, wherein the group-wagering game comprises a basic wagering game.

8. The wagering game system according to claim 1, wherein the group-wagering game comprises a supplemental game.

9. The wagering game system according to claim 4, wherein the supplemental game comprises a bonus game, a secondary game, or a progressive game.

10. The wagering game system according to claim 1, wherein each player in the wagering game system is provided an opportunity to unilaterally replace a player in the group with a computer generated player.

11. The wagering game system according to claim 1, wherein said group comprises at least one player having a wager on an outcome of said group-wagering game and at least one player whose game play at a respective gaming terminal influences an outcome of said group-wagering game, but does not participate in any award received by the group arising from said outcome of said group-wagering game.

12. The wagering game system according to claim 1, wherein each player in the wagering game system is provided an opportunity to unilaterally choose players who will play in a group-wagering game and influence an outcome therein.

13. The wagering game system according to claim 12, wherein said gaming control system prohibits players in a group who do not unilaterally choose to be a part of such group from receiving any part of any award received by the group.

14. The wagering game system according to claim 13, wherein said gaming control system is configured to provide players with an option of being a member of more than one group and to share in any award received by a group in which a player is a member upon satisfaction of a pre-condition.

15. The wagering game system according to claim 14, wherein the pre-condition comprises at least one of the input of an additional wager into the wagering game system or the input of an additional wager into the wagering game system for each group in which the player wants to be a part.

16. A wagering game system according to claim 1, wherein the gaming control system is configured to permit a player in the group of players, at a player's gaming terminal, to unilaterally alter a membership of another player of said group of players.

17. A wagering game system according to claim 16, wherein the gaming control system is further configured to display on the gaming terminal display selectable elements corresponding to players or gaming terminals eligible to participate in the group-wagering game.

18. A wagering game system according to claim 17, wherein the gaming control system is further configured to display on the gaming terminal display information corresponding to selectable elements, the information comprising game play statistics.

19. A method of conducting a group-wagering game involving a plurality of gaming terminals, each gaming terminal connected to a service and being controlled by a gaming control system, comprising the acts of:

defining at least one group of players from a plurality of players placing wagers on the group-wagering game on respective ones of said plurality of gaming terminals;

and permitting at least one player in said at least one group of players to utilize a player input device of the players' gaming terminal to unilaterally alter a membership of said at least one group of players by adding at least one other player to said at least one group of players or removing at least one other player from said at least one group of players, wherein the gaming control system is configured to, upon a removal of another player from the group, automatically place said another player into another group for continued and substantially uninterrupted play of the group-wagering game.

20. The method according to claim 19, further comprising the act of:

permitting said at least one player to unilaterally alter a membership of said at least one group of players during a group-wagering game comprising at least one of a basic wagering game and a supplemental wagering game, wherein the supplemental game comprises at least one of a bonus game, a secondary game, or a progressive game.

21. The method according to claim 20, further comprising the act of:

disclosing alteration of a membership of said at least one group of players to a removed player.

22. The method according to claim 21, further comprising the step of:

withholding disclosure of alteration of a membership of said at least one group of players to a removed player.

23. A method of conducting a group-wagering game involving a plurality of gaming terminals according to claim 19, wherein the act of defining at least one group of players from a plurality of players placing wagers on the group-wagering game is performed at a gaming terminal.

24. A method of conducting a group-wagering game involving a plurality of gaming terminals according to claim 19, wherein the act of permitting at least one player in said at least one group of players to unilaterally alter a membership of said at least one group of players by adding at least one other player to said at least one group of players or removing at least one other player from said at least one group of players is performed at a gaming terminal.

25. A method of operating a gaming terminal, comprising:

receiving a wagering input from a player to play a group-wagering game;

displaying on a display a separate indicia for each player in a group of players who will be participating in a group-wagering game with said player;

conducting a group-wagering game on said gaming terminal, wherein each player in said group of players inclusive of said player provides a separate input to the group-wagering game;

using the inputs by each player in said group of players to determine at least one of an outcome and an award of the group-wagering game;

displaying an outcome of the group-wagering game on a display of said gaming terminal, and permitting said player to unilaterally alter a membership of said group of players prior to said conducting of a group-wagering game or subsequent to said displaying of an outcome of the group-wagering game by adding at least one other player to said group of players or removing at least one other player from said group of players, wherein at least one player in the group of players from which the removed player was removed still influences, via a respective player input, an outcome or an award of the group-wagering game for said another group until such time as said removed player opts to unilaterally alter a membership of said another group to remove said at least one player from said another group.

* * * * *